United States Patent [19]

Sibler

[11] 4,050,281

[45] Sept. 27, 1977

[54] EXTRUSION PRESS WITH MULTIPURPOSE SIDE CYLINDERS

[75] Inventor: Guenter W. Sibler, Pittsburgh, Pa.

[73] Assignee: Sutton Engineering Company, Pittsburgh, Pa.

[21] Appl. No.: 646,408

[22] Filed: Jan. 2, 1976

[51] Int. Cl.[2] ..... B21C 23/08; B30B 11/30

[52] U.S. Cl. ..... 72/265

[58] Field of Search ..... 72/253, 264, 265, 268, 72/271, 272

[56] References Cited

U.S. PATENT DOCUMENTS

| | | | |
|---|---|---|---|
| 2,052,738 | 9/1936 | Albers | 72/265 |
| 2,063,563 | 12/1936 | Sparks | 72/272 |
| 2,132,974 | 10/1938 | Sentance et al. | 72/265 |
| 2,713,941 | 7/1955 | Schuler | 72/265 X |
| 3,357,227 | 12/1967 | Walker et al. | 72/253 |

FOREIGN PATENT DOCUMENTS

| | | | |
|---|---|---|---|
| 233,891 | 4/1911 | Germany | 72/265 |
| 1,002,721 | 2/1957 | Germany | 72/265 |
| 599,555 | 7/1934 | Germany | 72/265 |

*Primary Examiner*—C.W. Lanham
*Assistant Examiner*—D. M. Gurley
*Attorney, Agent, or Firm*—Brown, Murray, Flick & Peckham

[57] ABSTRACT

A stationary main cylinder, spaced behind a billet-receiving container located behind an extrusion die, contains a ram projecting from the front end of the cylinder. Piercer cylinders are mounted on the opposite sides of the main cylinder and have open front ends from which piston rods extend forward and carry coupling cylinders. A piercer crosshead in front of the ram is rigidly connected to the coupling cylinders behind an extrusion crosshead connected to the ram by means extending past the piercer crosshead. Plungers disposed in the coupling cylinders are rigidly connected with the extrusion crosshead, from which a hollow stem extends forward. A mandrel holder carried by the piercer crosshead extends forward through an opening in the extrusion crosshead for supporting a mandrel in the stem. Means are provided for supplying hydraulic fluid to the cylinders in a predetermined sequence to move the crossheads in unison and also relative to each other during piercing and extruding of a billet.

4 Claims, 5 Drawing Figures

EXTRUSION PRESS WITH MULTIPURPOSE SIDE CYLINDERS

It is among the objects of this invention to provide an extrusion press which is less expensive and has a shorter stroke than conventional presses of the same type, which is easier to maintain, which is capable of exerting the full force of the press against a billet during extrusion while the mandrel is stationary, and in which the mandrel cannot be pushed rearwardly by the extruding metal.

The preferred embodiment of the invention is illustrated somewhat schematically in the accompanying drawings, in which FIG. 1 is a horizontal longitudinal section showing a hollow billet in position for loading into a billet container;

Figure 1:
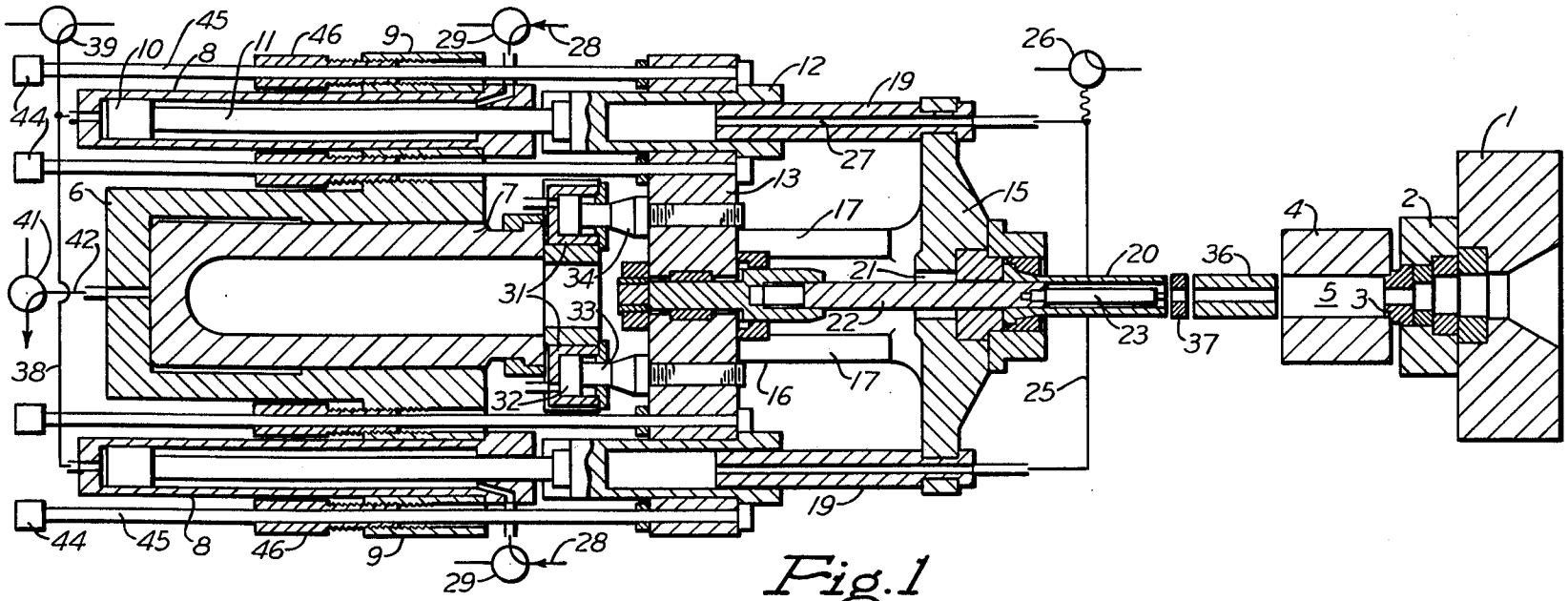

Referring to FIG. 1 of the drawings, the stationary front platen 1 of an extrusion press is provided with a passage through it, behind which is a die holder 2 containing an extrusion die 3 in the usual manner. Directly behind the die there is a container 4 provided with a billet-receiving passage 5 aligned with the die. Spaced behind the container is the apparatus for loading a billet into the container and then forcing it through the die to form a pipe or tubular extrusion.

This apparatus includes a large diameter central main cylinder 6 that is stationary; i.e., it is mounted a fixed distance from the front platen. The cylinder is aligned with the passage through the billet container and has an open front end. Slidably disposed in this cylinder is a ram 7 that projects from its front end. At opposite sides of the cylinder a pair of piercer cylinders 8 are rigidly mounted parallel to the main cylinder between them. They may be mounted in lateral extensions 9 of the front end portion of the main cylinder, or in any other convenient way. The piercer cylinders contain pistons 10, from which piston rods 11 extend forward and out of the front ends of the cylinders. The front ends of the piston rods are rigidly connected to the rear ends of a pair of coupling cylinders 12, which have open front ends. These coupling cylinders are rigidly mounted in a piercer crosshead 13 in front of ram 7, whereby when pistons 10 are moved forward, they will move the crosshead forward with them.

In front of the piercer crosshead there is an extrusion crosshead 15 that is rigidly connected with the ram by means extending past the piercer crosshead. Such means may consist of a large rigid hollow strut 16 provided with diametrically opposite longitudinal slots 17, through which the piercer crosshead extends and in which it can move lengthwise of the strut.

Rigidly connected with extrusion crosshead 15, such as by having their front ends mounted in its opposite ends, are plungers 19 that are slidably disposed in coupling cylinders 12. The extrusion crosshead also supports the rear end of a hollow extruding stem 20 that extends forward from it in axial alignment with the passage through the billet container. The stem is of such size that it can be inserted in the container passage, but before there is a billet in the container the front end of the stem is spaced behind the container. Behind the stem the extrusion crosshead is provided with an opening 21, through which extends a holder 22 for a mandrel 23 that is disposed in the hollow stem. The rear end of the mandrel holder is supported by the piercer crosshead 13.

It will be seen that by introducing hydraulic pressure into the rear ends of the cylinders, the two crossheads can be moved forward together or one can be moved forward relative to the other. Suitable piping and valves connect the rear ends of the main and piercer cylinders with a source of hydraulic pressure and with the supply tank of the hydraulic system. Other piping 25 and valve 26 connected to the front ends of axial passages 27 through plungers 19 supply the coupling cylinders 12 with hydraulic fluid or permit it to escape therefrom. Still further piping 28 and a valve or valves 29 connect the front ends of the piercer cylinders 8 with the source of hydraulic pressure and the tank.

The ram 7 is provided with a pair of safety cylinders 31, in which there are pistons 32 provided with stub rods 33 projecting from the front of the cylinders. While the crossheads are retracted as shown in FIG. 1, stops 34 carried by the piercer crosshead 13 engage the stub rods, and the pistons 32 are at the inner ends of the safety cylinders. The stops are adjustable in the piercer crosshead lengthwise of the extrusion press, such as by being threaded therein or in any other suitable manner.

OPERATION

Figure 2:
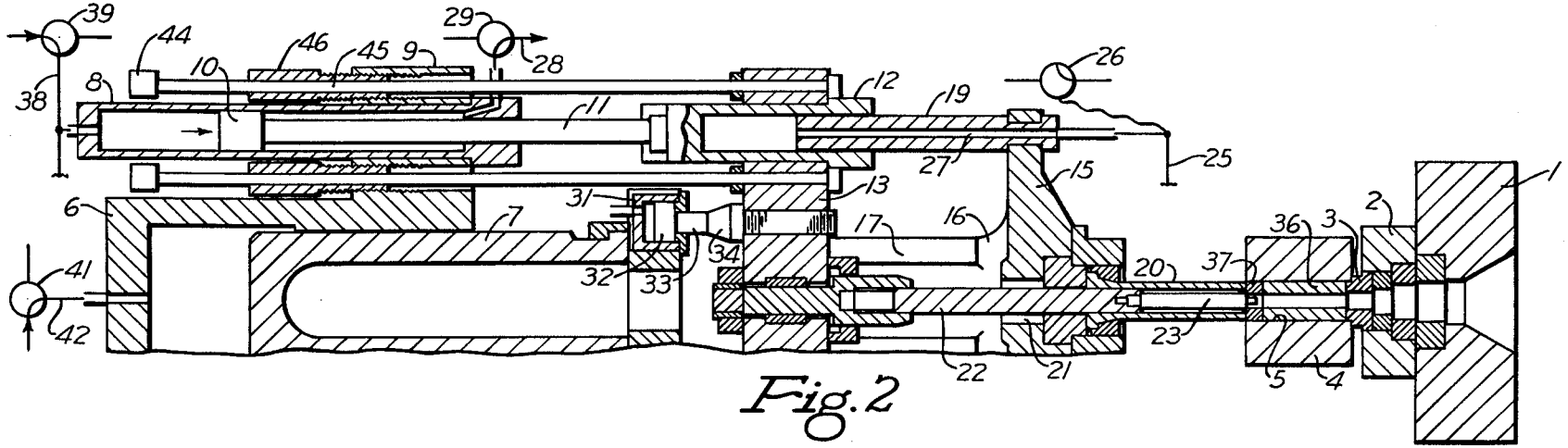
FIG. 2 is a fragmentary view similar to FIG. 1, but with the movable parts moved part way forward to load the billet.

When the parts of the press are in the position shown in FIG. 1, a hollow or solid billet 36 and a hollow dummy block 37 are moved into loading position between the front end of hollow stem 20 and the rear of the billet container passage. The first step in thereafter operating the press is to deliver hydraulic pressure to safety cylinders 31 to cause the pistons therein to move the piercer crosshead forward far enough to move the front end of the mandrel into the opening in the dummy block until the front face of the mandrel is substantially flush with the front face of the block. This movement of the piercer crosshead pulls pistons 10 and coupling cylinders 12 forward and thereby draws hydraulic fluid into the rear ends of cylinders 8 through piping 38 and a valve 39 while fluid is allowed to escape from the front ends of cylinders 8 to the tank through valves 29. At the same time, coupling cylinders 12 force some fluid out through plungers 19 and valve 26 to the tank. Then, as shown in FIG. 2, fluid is locked in the coupling cylinders by closing valve 26, and hydraulic pressure is delivered to the rear ends of the piercer cylinders through valve 39 and piping 38 so that both crossheads will be moved forward together rapidly. This will cause the hollow stem to push the billet and dummy block into the container. During this operation, fluid is drawn from the tank through a valve 41 and piping 42 and into the main cylinder by the forwardly-moving ram.

When extruding such metal as copper and its alloys, for example, where a solid billet will be pierced and where precise upsetting of the billet prior to piercing is very important in order to obtain a concentric tube, hydraulic pressure is delivered to the main cylinder 6 by operating valve 41 to connect the pressure source with the cylinder. This will force ram 7 forward to upset the billet in the container. Then hydraulic pressure is applied to the front ends of cylinders 8 so that pistons 10 will pull the ram and extrusion crosshead 15 back just far enough to permit the billet to flow backward around the mandrel during the piercing step that follows next.

Figures 3, 4, 5:
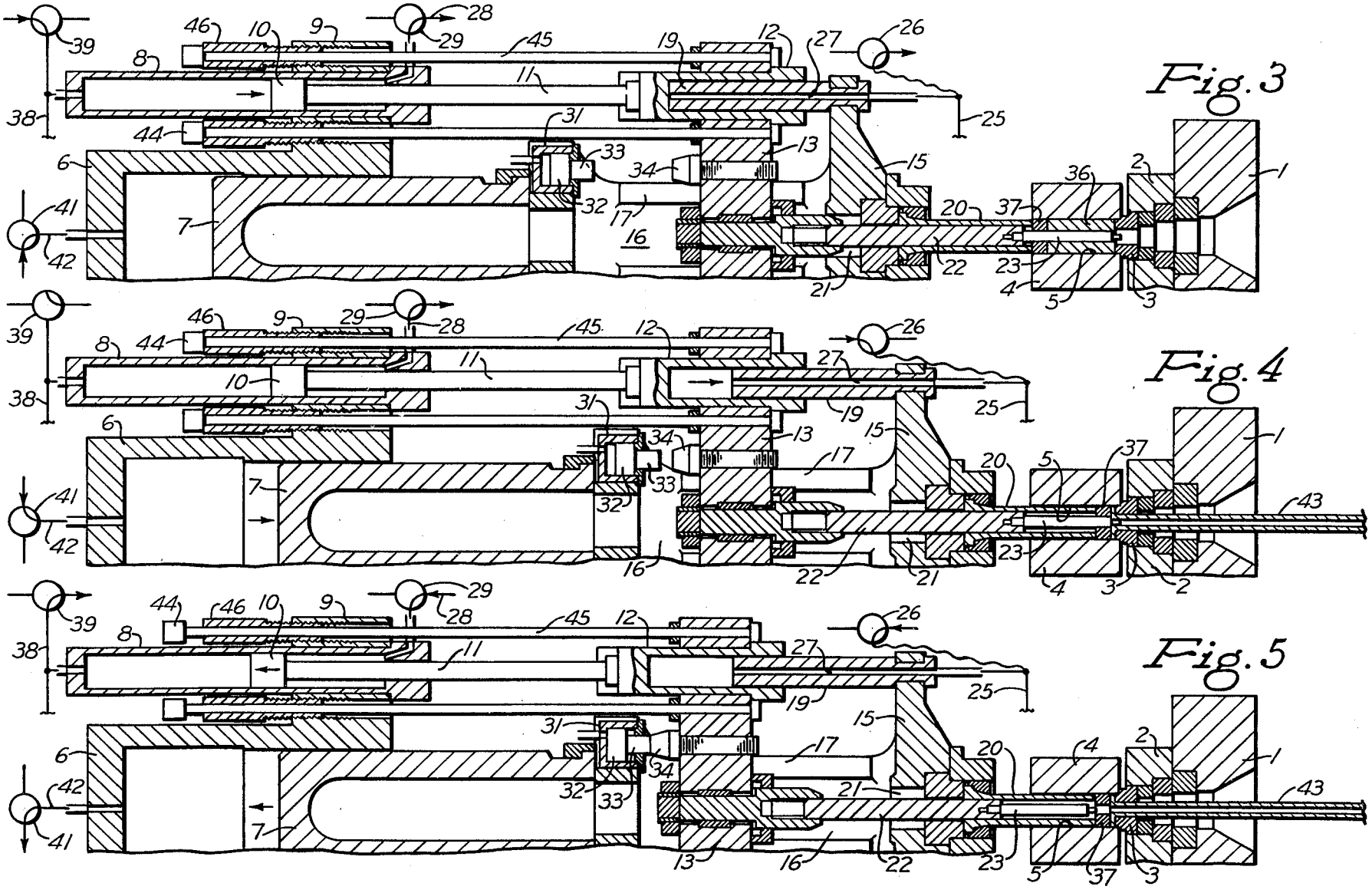
FIG. 3 is a view similar to FIG. 2, but showing the mandrel forced through the billet.
FIG. 4 is a view similar to FIG. 3, but showing the billet extruded to form a pipe or tube.
FIG. 5 is a view similar to FIG. 4, but with the movable parts starting to move back to remove the hollow stem and mandrel from the container.

Whether a hollow billet or an upset solid billet is in the container, the valve 26 connected with the hollow plungers 19 now is turned to release the fluid from the coupling cylinders, and hydraulic pressure is applied to the rear ends of the piercer cylinders, as shown in FIG. 3. This causes the piercer crosshead 13 to be moved forward while the extrusion crosshead 15 remains stationary because the hollow stem is prevented by the billet from moving forward. Since the plungers are connected with tank, the coupling cylinders can be moved forward on the stationary plungers. The result is that the mandrel is moved forward through the dummy block and hollow stem and also through the billet.

The next step, as shown in FIG. 4, is to again connect plungers 19 with hydraulic pressure and to apply pressure to the rear end of the ram in the main cylinder so that the ram and the plungers are forced forward together while the fluid in the rear ends of the piercer cylinders is locked in by closing valve 39. This will cause the full power of the press to be applied to the hollow stem when extruding over arrested mandrel, so that the stem will enter the billet container and force the billet through the extrusion die, with the result that a hollow extrusion 43 is formed and moves forward out of the front platen of the press.

At the completion of the extruding operation just described, the coupling cylinders and the rear ends of the main and piercer cylinders are connected with the tank, as shown in FIG. 5, and the front ends of the piercer cylinders are connected with the source of hydraulic pressure so that pistons 10 are moved rearwardly to pull the piercer crosshead 13 back into engagement with the ram. From then on, the rearwardly-moving piercer crosshead pushes the ram rearwardly in the main cylinder and thereby pulls the extrusion crosshead back with it until the two crossheads are back in the positions shown in FIG. 1, with the hollow stem and mandrel spaced from the billet container so that a new billet can be loaded after the various valves have been returned to the positions indicated in FIG. 1.

Engagement of the pistons with the front ends of piercer cylinders 8 does not occur and, therefore, is not relied upon to limit the distance the piercer crosshead and mandrel can be moved forward, because it is desirable to provide adjustable means for this purpose. Adjustment is accomplished with the aid of stops 44 behind the piercer crosshead, which are connected with it by tension means, such as rods 45 that can slide in the lateral extensions 9 of the main cylinder. In their forward position these stops engage abutments 46 supported by the lateral extensions. These abutments are adjustable lengthwise of the cylinders in any manner so that the position of the mandrel relative to the die can be adjusted.

Stops 34 are adjustable in order to vary the position of the mandrel in the hollow stem. When pistons 32 are moved forward in safety cylinders 31 as previously described, the front end of the mandrel will protrude beyond the hollow stem a distance substantially equal to the thickness of the dummy block, thereby reducing the maximum distance required between the container and the retracted stem. This permits the press to be built with a shorter stroke, which results in a saving in the cost of the press. Nevertheless, the stroke of the pistons in the safety cylinders will allow ram 7 to complete its full forward movement in case of ejecting a failed billet from the container, without breaking rods 45 apart when the adjustable abutments 46 are set to arrest the mandrel in the proper position relative to the die.

In a conventional extrusion press of this type the mandrel is operated from a double-acting cylinder inside the central ram. Consequently, part of the hydraulic pressure behind the ram must be used for overcoming the pressure in that cylinder that holds the mandrel in its forward position as the ram is moved forward relative to the ram to extrude the billet. With the press disclosed herein, an important feature is that the cylinder in the ram is eliminated, so the full pressure of the press can be used for extruding while the mandrel is stationary inside the billet. Another advantage is that by locating the piercer cylinders outside of the ram and main central cylinder, they are easier to maintain.

The piercer cylinders, in conjunction with the coupling cylinders, serve as rapid advance and return cylinders. These two pairs of cylinders can also cooperate to pull a struck mandrel from the butt end of the extrusion, by supplying fluid pressure to the front ends of cylinders 8 and to the coupling cylinders while fluid is allowed to escape from main cylinder 6 and the rear ends of the piercer cylinders.

During actual extrusion, the valves at the rear ends of the piercer cylinders are closed to lock the hydraulic fluid in those cylinders in order to prevent the extrusion force, acting on the ring area of the arrested step mandrel, from pushing the mandrel back away from the die as the billet length decreases and the extrusion force overcomes the friction force attempting to pull the mandrel forward.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A press for extruding billets through a die, comprising an extrusion die holder, a billet container behind the die holder provided with a billet-receiving passage therethrough aligned with the die holder, a stationary main cylinder spaced behind the container and aligned with the container passage, the cylinder having an open front end, a ram slidably disposed in the cylinder, a piercer cylinder rigidly mounted at each side of the main cylinder parallel thereto and having an open front end, a piston in each piercer cylinder, a piston rod connected to each piston and extending out of the front end of the surrounding cylinder, a coupling cylinder mounted on the front end of each rod and extending forward therefrom and having an open front end, a piercer crosshead in front of the ram rigidly connected to said coupling cylinders, an extrusion crosshead in front of the piercer crosshead, means extending past the piercer crosshead and rigidly connecting the extrusion crosshead to said ram for movement by it, plungers slidably disposed in said coupling cylinders and rigidly connected with the extrusion crosshead, a hollow stem mounted on the extrusion crosshead and extending forward therefrom in axial alignment with said container passage for insertion therein, the extrusion crosshead having an opening through it behind the stem, a mandrel holder carried by the piercer crosshead and extending forward through said opening, a mandrel in said stem supported by said mandrel holder and having a tip at its front end of smaller diameter than the mandrel body behind it, means for supplying hydraulic fluid to the rear ends of the piercer cylinders while fluid is locked in the coupling cylinders to move said stem forward to the billet container, means for then exhausting fluid from the coupling cylinders to permit the forwardly moving piercer crosshead to move the mandrel forward from the stem into said container, stops behind the piercer crosshead connected with that crosshead for movement thereby, abutment means engageable by said stops to arrest the forward movement of the piercer crosshead as soon as only said tip of the mandrel projects into a die in the die holder, and means for then supplying hydraulic fluid to said main cylinder and the coupling cylinders to move said stem forward into the container with the full power of the press to extrude a billet through the die while the piercer crosshead and mandrel are held stationary by said stops.

2. A press according to claim 1, including a pair of safety cylinders mounted on the ram behind the piercer crosshead, pistons disposed in the safety cylinders and projecting forward therefrom, and means for supplying hydraulic fluid to the safety cylinders to cause the pistons therein to move the piercer crosshead forward relative to said ram.

3. A press according to claim 2, including stops secured to the piercer crosshead and engageable by the pistons projecting from said safety cylinders, said stops being adjustable lengthwise of the press relative to the piercer crosshead.

4. A press according to claim 1, in which said plungers are provided with axial fluid passages therethrough, and the front ends of said fluid passages are connected with said fluid-supplying means.

* * * * *